US008113185B2

(12) United States Patent
Song

(10) Patent No.: US 8,113,185 B2
(45) Date of Patent: Feb. 14, 2012

(54) DEVICE FOR SEPARATING OIL FROM BLOW-BY GAS

(75) Inventor: Kye Oong Song, Yongin-si (KR)

(73) Assignees: Hyundai Motor Company, Seoul (KR); Kia Motor Corporation, Seoul (KR)

( * ) Notice: Subject to any disclaimer, the term of this patent is extended or adjusted under 35 U.S.C. 154(b) by 444 days.

(21) Appl. No.: 12/354,625

(22) Filed: Jan. 15, 2009

(65) Prior Publication Data

US 2010/0018493 A1 Jan. 28, 2010

(30) Foreign Application Priority Data

Jul. 25, 2008 (KR) ..... 10-2008-0073090

(51) Int. Cl.
*F02B 25/06* (2006.01)

(52) U.S. Cl. ..... 123/572

(58) Field of Classification Search ..... 123/572–574, 123/41.86
See application file for complete search history.

(56) References Cited

U.S. PATENT DOCUMENTS

| | | | | |
|---|---|---|---|---|
| 2005/0005921 | A1* | 1/2005 | Ikeda et al. | 123/572 |
| 2005/0092267 | A1* | 5/2005 | Nonaka et al. | 123/41.86 |
| 2007/0215128 | A1* | 9/2007 | Yonebayashi et al. | 123/572 |
| 2007/0272176 | A1* | 11/2007 | Wagner et al. | 123/41.86 |
| 2007/0281205 | A1* | 12/2007 | Wagner et al. | 429/49 |
| 2008/0127953 | A1* | 6/2008 | Shieh et al. | 123/573 |
| 2008/0135030 | A1* | 6/2008 | Knaus et al. | 123/572 |
| 2008/0223348 | A1* | 9/2008 | Togasawa | 123/572 |

FOREIGN PATENT DOCUMENTS

| | | | |
|---|---|---|---|
| JP | 63-147516 | U | 9/1988 |
| JP | 08-158853 | A | 6/1996 |
| JP | 2003-120248 | A | 4/2003 |
| JP | 2004-245148 | A | 9/2004 |
| JP | 2006-009676 | A | 1/2006 |
| JP | 2006-336619 | A | 12/2006 |
| KR | 10-2004-0039338 | A | 5/2004 |

* cited by examiner

*Primary Examiner* — M. McMahon

(74) *Attorney, Agent, or Firm* — Morgan, Lewis & Bockius LLP

(57) ABSTRACT

A device for separating oil includes a blow-by gas passage provided to a head cover to discharge blow-by gas introduced from an engine and a separator coupled to the blow-by gas passage to separate oil from the blow-by gas. The device for separating oil from blow-by gases can effectively separate oil from the blow-by gas. Since the blow-by gas passage for discharging the blow-by gas is provided to the head cover, a hose or a pipe is not required to carry the blow-by gas, and thereby the engine can be designed to be compact.

16 Claims, 5 Drawing Sheets

DEVICE FOR SEPARATING OIL FROM BLOW-BY GAS

CROSS-REFERENCE TO RELATED APPLICATION

The present application claims the priority to Korean Patent Application No. 10-2008-0073090 on Jul. 25, 2008, the entire contents of which application is incorporated herein for all purposes by this reference.

BACKGROUND OF THE INVENTION

1. Field of the Invention

The present invention relates to a device for separating oil from blow-by gases, and more particularly, to a device for separating oil, which is integrally provided to a head cover of an engine so as to make the engine be compact and also to improve oil separating efficiency.

2. Description of Related Art

Emissions from automobiles are generally divided into three types according to their sources: exhaust gas produced through the combustion of fuel-air mixture in a cylinder and exhausted via an exhaust system; evaporation gas evaporated from fuel in a fuel tank; and blow-by gas, such as a portion of the fuel-gas mixture or unburned gas, which has leaked into a crank case from a combustion chamber.

Here, the blow-by gas indicates gas, which has leaked into the crank case from the combustion chamber through a gap between a cylinder and a piston during a compression stroke and an expansion stroke. The blow-by gas, after having leaked into the crank case from the combustion chamber, passes sequentially through a blow-by gas passage, a cylinder head and a head cover of a cylinder block.

The blow-by gas creates some problems, which are more severe in a diesel engine than in a gasoline engine. This is because, in case of the diesel engine having a high compression ratio, compressed gas under high pressure leaks into the crank case from the cylinder through the gap between the cylinder and the piston. Especially, in a diesel engine using a turbocharger, when a blow-by gas outlet of the crank case or the cylinder head is directly connected to a suction passage, high negative suction pressure increases flow rate thereby lowering pressure, so that the blow-by gas is rapidly absorbed from the crank case into the suction side, thereby dropping the pressure inside the crank case to be abnormally low. This as a result can cause critical damages to the quality and endurance of the engine. For example, the consumption of engine oil sharply increases, oil leaks from respective seals, or dust is introduced into the engine.

Considering that the blow-by gas gives an adverse effect to the quality of the exhaust gas and the engine may consume more engine oil when more blow-by gas is produced, it is more important among others to completely separate engine oil, which moves along with a flow of the blow-by gas, from the blow-by gas while effectively circulating the blow-by gas. For this, the flow of the blow-by gas is obstructed so that the oil can be separated from the blow-by gas through collision. Further, a filter or the like is installed on a flow path of the blow-by gas in order to separate cohesive oil droplets from the blow-by gas when the blow-by gas is passing through the filter.

In order to separate the oil from the blow-by gas, an external separator is additionally mounted on the exterior of the head cover or a baffle or a sheet of nonwoven cloth is mounted inside the head cover.

However, the method of separating engine oil using the baffle or the nonwoven cloth does not sufficiently separate the oil and thus is not suitable to be used in consideration of latest emission regulations, which are getting gradually stronger. Furthermore, the external separator mounted on the head cover increases the size of the engine, thereby making it difficult to design the engine to be compact.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a device for separating oil from blow-by gases, which can effectively separate oil from blow-by gas, and is integrally provided to a head cover of an engine so as to make the engine be compact.

In an aspect of the present invention, the device for separating oil may include a blow-by gas passage provided to a head cover of an engine and discharging blow-by gas introduced from the engine therethrough, and/or a separator coupled to the blow-by gas passage and separating oil from the blow-by gas.

The blow-by gas passage may be formed non-linear so as to induce turbulence to the blow-by gas therein.

The blow-by gas passage may have an oil drain in a bottom thereof to discharge the separated oil. A nipple may be provided to the oil drain, wherein an interval between the oil drain and the nipple is formed to receive the discharged oil therebetween so as to prevent the discharged oil from flowing back.

The separator may include a pre-separator into which the blow-by gas enters and separating the oil from the blow-by gas. The pre-separator may include inlet hole and spiral guide vane formed on inside wall thereof and configured to twist the blow-by gas passing through the spiral guide vane in order to increase a flow rate of the blow-by gas. The pre-separator may be arranged substantially in parallel to flow direction of the blow-by gas entering the blow-by gas passage. The separator may further include a main separator separating the oil from the blow-by gas. The main separator may be made up of a block having a through-hole aligned with a predetermined angle with respect to the flow direction of the blow-by gas entering the main separator. The pre-separator and the main separator may be arranged in such a manner that the blow-by gas entering the blow-by gas passage passes sequentially through the pre-separator and the main separator. The pre-separator and the main separator may be arranged in such a manner that a flow direction of the blow-by gas passing through the pre-separator is inclined from a flow direction of the blow-by gas passing through the main separator with a predetermined angle.

The blow-by gas passage may have, downstream of the main separator, an impact shield against which the blow-by gas collides.

The separator may include a main separator separating the oil from the blow-by gas. The main separator may be made up of a block having a through-hole aligned with a predetermined angle with respect to the flow direction entering the main separator. The blow-by gas passage may have, downstream of the main separator, an impact shield against which the blow-by gas collides.

The blow-by gas passage may include an inlet, wherein the blow-by gas introduced to the head cover flows upwards to enter the inlet, an outlet formed in the head cover to discharge the introduced blow-by gas, and/or a flow path connecting the inlet to the outlet, wherein the flow path is bent at least once.

A protrusion may be formed on inside wall of the blow-by gas passage in order to separate the oil from the blow-by gas. The protrusion may be inclined in the forward direction of the blow-by gas so that contact surface with flow is increased and thus streamlined flow is achieved.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
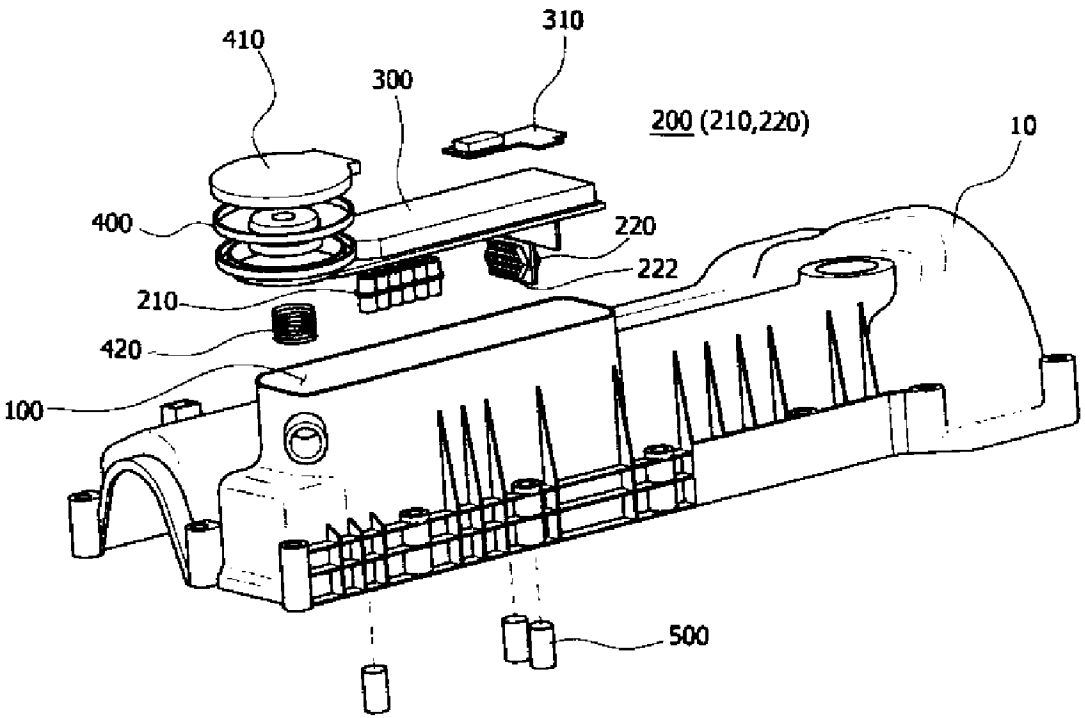
FIG. 1 is an exploded perspective view illustrating an exemplary device for separating oil according to the present invention.
Figure 2:
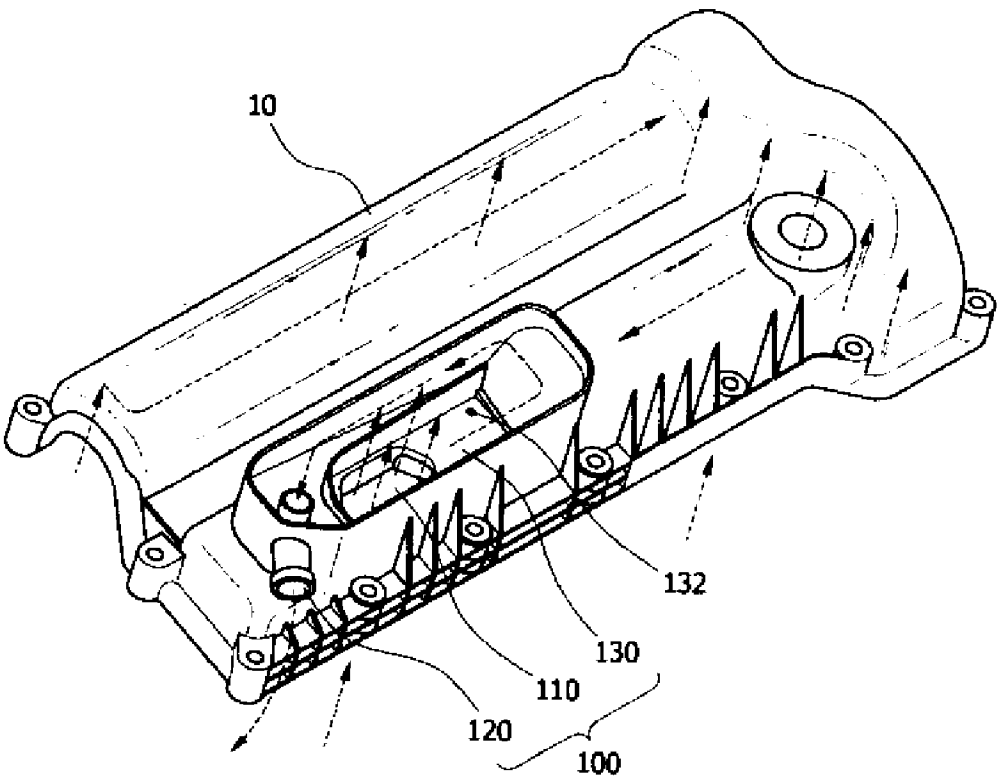
FIG. 2 is a perspective view illustrating the configuration of a blow-by gas passage of an exemplary device for separating oil according to the present invention.

FIG. 1 is an exploded perspective view illustrating a device for separating oil according to various aspects of the present invention, and FIG. 2 is a perspective view illustrating the configuration of a blow-by gas passage of the device for separating oil according to various aspects of the present invention.

As shown in FIGS. 1 and 2, the device for separating oil according to various aspects of the present invention includes a blow-by gas passage 10, which is formed in a head cover so as to discharge blow-by gas introduced from an engine, and a separator 200, which is coupled to the blow-by gas passage 100 to separate oil from the blow-by gas.

While the blow-by gas passage 100 may be formed by perforating the head cover, this can make it very difficult to fabricate the blow-by gas passage 100. It is preferable that the blow-by gas passage 100 be formed as a groove in the upper portion of the head cover 10 and a passage cover 300 be seated on the upper portion of the blow-by gas passage 100, so that the blow-by gas can flow in the groove of the blow-by gas passage 100. The passage cover 300 may be provided with a bypass valve 310 so that the blow-by gas can bypass the blow-by gas passage 100 if necessary.

The device for separating oil according to various aspects of the present invention as described above does not require a hose or a pipe to carry the blow-by gas, leaked from the engine, to the separator 200, and thereby can make the engine be more compact.

If the blow-by gas passage 100 is formed linear, the blow-by gas will not be turbulent and thus oil separation, which is created in the blow-by gas colliding against the inside wall of the blow-by gas passage 100, will not actively take place.

Preferably, the blow-by gas passage 100 includes an inlet, which is configured in such a manner that the blow-by gas introduced to the head cover flows upwards to enter the inlet, an outlet 120, which is formed in the head cover so as to discharge the introduced blow-by gas, and a flow path 130, which connects the inlet to the outlet 120 and is bent once or more. In the blow-by gas passage 100 of this embodiment constructed as above, the blow-by gas will flow upwards inside the inlet, make a U-turn in the horizontal direction in the flow path 130, and be bent sideways in the outlet 120, thereby causing oil separation to be more active.

Further, a positive crankcase ventilation (PCV) valve 400 is mounted on the outlet 120 to adjust the discharge of the blow-by gas, and a PCV valve cover 410 is coupled to the upper portion of the PCV valve 400. The PCV valve 400 is a component that blocks a path toward the outlet 120 using a force of an elastic body 420 but opens the path toward the outlet 120 if the pressure of the blow-by gas increases to a preset level or more. The PCV valve 400 has substantially the same construction and operation as a known PCV valve, and thus will not be described in detail.

If the separator 200 is implemented with one structure such as a simple baffle or a sheet of nonwoven cloth as in the related art, oil will not effectively separated. For this, the separator 200 includes a pre-separator 210 and a main separator 220, which are arranged in such a manner that the blow-by gas entering the blow-by gas passage 100 can pass sequentially through the pre-separator 210 and the main separator 220.

The pre-separator 210 and the main separator 220 are also arranged in such a manner that the direction of the blow-by gas flowing in the pre-separator 210 crosses each the direction of the blow-by gas flowing in the main separator 220. As illustrated in this embodiment, the pre-separator 210 is mounted on the inlet, in which the blow-by gas flows upwards, and the main separator 220 is mounted on the flow path 130, in which the blow-by gas horizontally flows, so that the blow-by gas changes the direction while flowing through the pre-separator 210 and the main separator 220, thereby enabling the oil to be more effectively separated from the blow-by gas.

Here, an oil drain hole 132 is formed in the bottom of the blow-by gas passage 100 so as to drain out the oil, which has been separated from the blow-by gas through the pre-separator 210 and the main separator 220. The number and positions of the oil drain holes 132 can be freely changed according to the shape and characteristics of the engine and the head cover.

Figure 3:
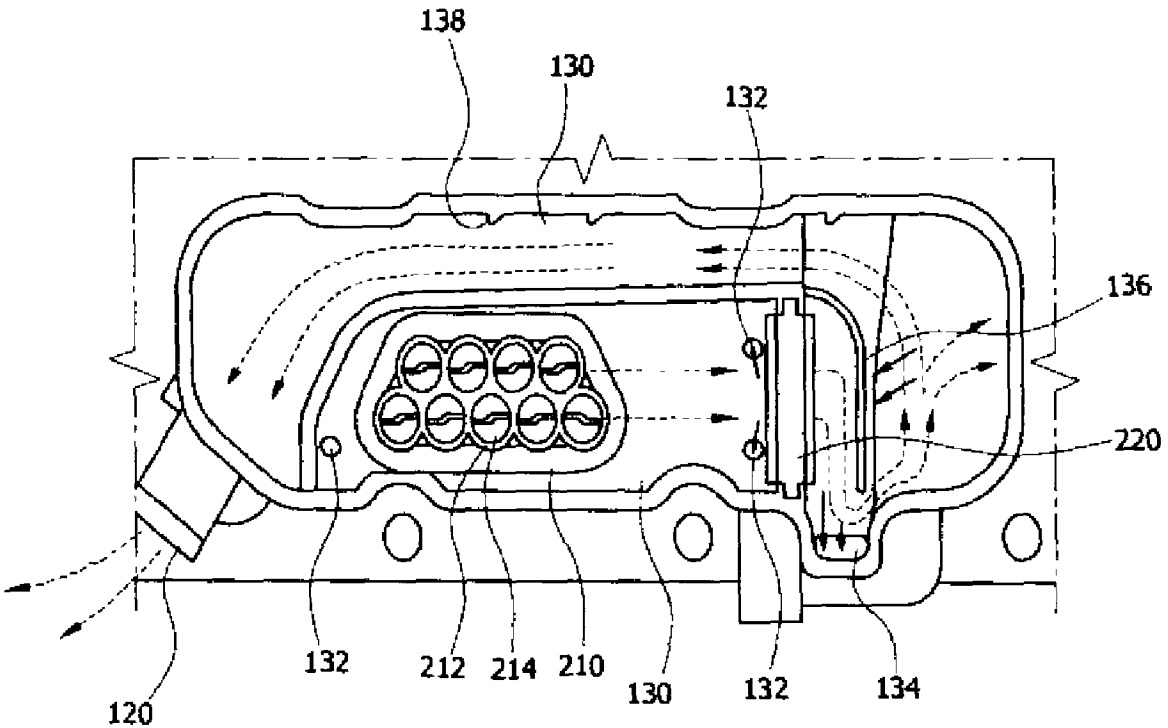
FIG. 3 is a plan view illustrating an exemplary device for separating oil according to the present invention.
Figure 4:
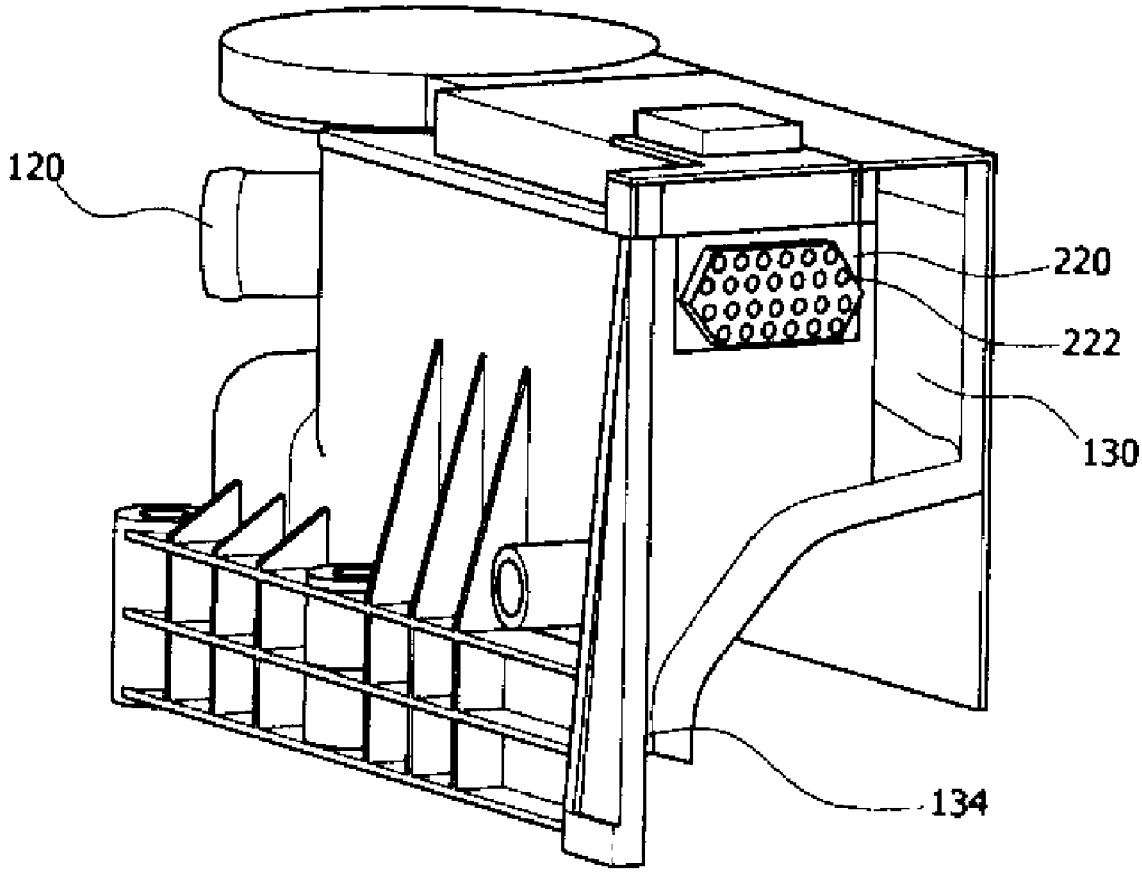
FIG. 4 is a rear cross-sectional perspective view illustrating an exemplary device for separating oil according to the present invention.
Figure 5:
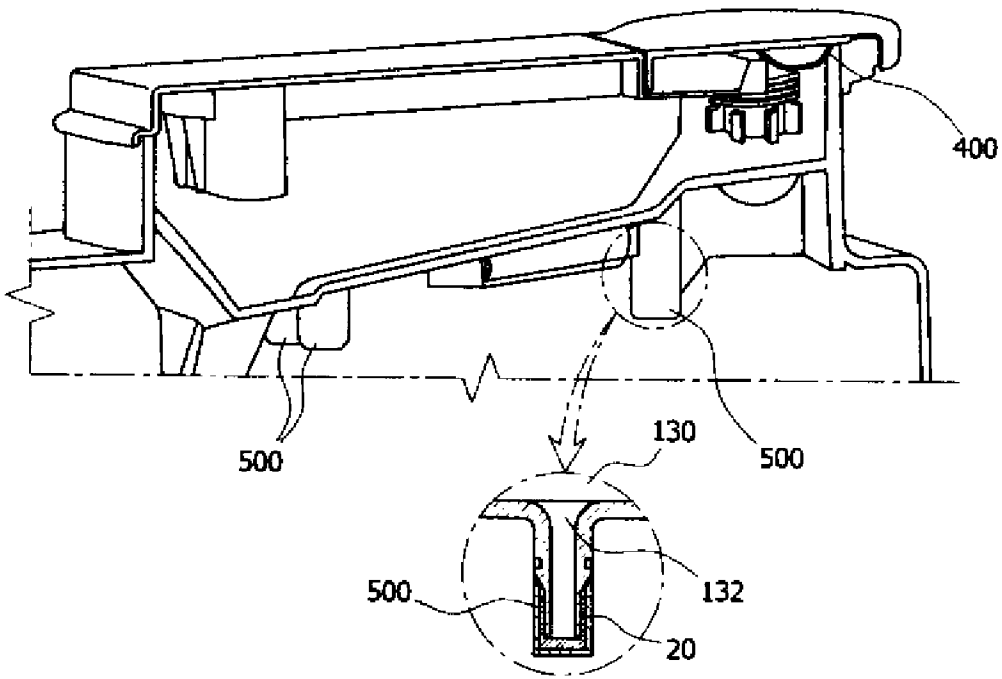
FIG. 5 is a side cross-sectional perspective view illustrating an exemplary device for separating oil according to the present invention.

FIG. 3 is a plan view illustrating the device for separating oil according to various aspects of the present invention, FIG. 4 is a rear cross-sectional perspective view illustrating the device for separating oil according to various aspects of the present invention, and FIG. 5 is a side cross-sectional perspective view illustrating the device for separating oil according to various aspects of the present invention. Here, dotted arrows indicate the flowing direction of the blow-by gas and solid arrows indicate the flowing direction of the oil separated from the blow-by gas.

When the device for separating oil according to various aspects of the present invention is used, as shown in FIG. 3, the blow-by gas produced in the engine will flow upwards through the pre-separator 210 mounted on the inlet, enter the blow-by gas passage 100, and then horizontally flow (to the left in FIG. 3) to pass through the main separator 220. The oil will be separated from the blow-by gas while the gas is passing through the pre-separator 210 and the main separator 220, and then be collected to an oil pan through the oil drain hole 132 in the bottom of the flow path 130.

Here, the pre-separator 210 has a plurality of inlet holes 212, through which the blow-by gas can enter the pre-separator 210, and spiral guide vanes 214, each of which is formed on the inside wall of a respective inlet hole 212. The spiral guide vanes 214 on the inside wall of the inlet holes 212 act to twist the flow of the blow-by gas passing through the inlet holes 212, thereby increasing the flow rate of the blow-by gas. When the flow rate of the blow-by gas is increased, the oil can be separated from a pure gas component due to the difference in specific gravity between the oil and the gas component. It can be appreciated that this structure further improves the effect of separating the oil from the blow-by gas.

Further, the main separator 220 is made up of a block having a plurality of through-holes 222 formed therein (see FIG. 1). Since the through-holes 222 are formed to have a very small diameter, the blow-by gas contacts the inside wall of the through-holes 222 while passing through the holes 222, thereby helping the oil be separated therefrom. The number, size, configuration and the like of the through-holes 222 can be freely changed according to several requirements such as the characteristics of the blow-by gas and the shape of the blow-by gas passage 100.

In an aspect, the through-holes 222 may be aligned in parallel to the longitudinal direction of the flow path 130. However, to increase flow resistance, the through-holes 222 may be aligned with a predetermined degree with respect to the longitudinal direction of the flow path 130.

The blow-by gas, after having passed through the main separator 220, makes a U-turn and exits through the outlet 120.

To separate the oil from the blow-by gas once again immediately after the blow-by gas has passed through the main separator 220, an impact shield 136 is provided to the rear end of the main separator 220 in the blow-by gas passage 100. With this construction, the oil is separated once again from the blow-by gas when the blow-by gas collides against the impact shield 136 after having passed through the main separator 220. To discharge the oil separated by the impact shield 136, an oil outlet 134 is formed in the bottom of the flow path 130.

Further, a plurality of protrusions 138 are formed on the inside wall of the blow-by gas passage 100 in order to more effectively separate the oil from the blow-by gas, which flows along the inside wall of the flow path 130. The protrusion may be inclined in the forward direction of flow so that contact surface with flow is increased and further streamlined flow is achieved.

The protrusions 138 perform a similar function to the baffle of the conventional device for separating oil, and thus will not be described in detail.

As shown in FIG. 5, nipples 500 are provided to prevent the separated oil from flowing back into the oil drain holes 132. Each of the nipples 500 is mounted on a respective oil drain hole 132 to surround the opening of the oil drain hole 132, which is protruded downwards. A predetermined interval is defined between the inside surface of the nipple 500 and the outside surface of the opening of the oil drain hole 132. Then, oil 20 draining through the oil drain hole 132 can enter, due to osmotic pressure, the interval between the inside surface of the nipple 500 and the outside surface of the opening of the oil drain hole 132. Therefore, even if a certain amount of the oil 20 is filled in the nipple 500, it does not flow back through the oil drain hole 132 because of sealing effect therebetween.

The means for preventing oil from flowing back as described above is not limited to the nipple 500 illustrated in this embodiment, but can be replaced with any construction or means which can prevent fluid from flowing back.

According to various aspects of the present invention, the device for separating oil from blow-by gases can effectively separate oil from the blow-by gas. Since the blow-by gas passage for discharging the blow-by gas is provided to the head cover, a hose or a pipe is not required to carry the blow-by gas, and thereby the engine can be designed to be compact.

For convenience in explanation and accurate definition in the appended claims, the terms "upper", "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A device for separating oil, comprising:

a blow-by gas passage provided to a head cover of an engine and discharging blow-by gas introduced from the engine therethrough; and a separator disposed in the blow-by gas passage and separating oil from the blow-by gas;

wherein the separator includes:

a pre-separator into which the blow-by gas enters and separates the oil from the blow-by gas, the pre-separator having inlet hole formed upwards and spiral guide vane formed on inside wall of the inlet hole and configured to twist the blow-by gas passing through the spiral guide vane in order to increase a flow rate of the blow-by gas; and a main separator separating the oil from the blow-by gas passing the pre-separator, wherein the blow-by gas passage includes:

an inlet, wherein the blow-by gas introduced to the head cover flows upwards to enter the inlet;

an outlet formed in the head cover to discharge the introduced blow-by gas; and a flow path connecting the inlet to the outlet, wherein the flow path is bent at least once.

2. The device according to claim 1, wherein the blow-by gas passage is formed non-linear so as to induce turbulence to the blow-by gas therein.

3. The device according to claim 1, wherein the blow-by gas passage has an oil drain in a bottom thereof to discharge the separated oil.

4. The device according to claim 3, further comprising a nipple provided to the oil drain, wherein an interval between the oil drain and the nipple is formed to receive the discharged oil therebetween so as to prevent the discharged oil from flowing back.

5. The device according to claim 1, wherein the pre-separator is arranged substantially in parallel to flow direction of the blow-by gas entering the blow-by gas passage.

6. The device according to claim 1, wherein the main separator is made up of a block having a through-hole aligned with a predetermined angle with respect to the flow direction of the blow-by gas entering the main separator.

7. The device according to claim 1, wherein the pre-separator and the main separator are arranged in such a manner that the blow-by gas entering the blow-by gas passage passes sequentially through the pre-separator and the main separator.

8. The device according to claim 1, wherein the pre-separator and the main separator are arranged in such a manner that a flow direction of the blow-by gas passing through the pre-separator is inclined from a flow direction of the blow-by gas passing through the main separator with a predetermined angle.

9. The device according to claim 1, wherein the blow-by gas passage has, downstream of the main separator, an impact shield against which the blow-by gas collides.

10. The device according to claim 1, wherein the separator includes a main separator separating the oil from the blow-by gas.

11. The device according to claim 10, wherein the main separator is made up of a block having a through-hole aligned with a predetermined angle with respect to the flow direction entering the main separator.

12. The device according to claim 10, wherein the blow-by gas passage has, downstream of the main separator, an impact shield against which the blow-by gas collides.

13. The device according to claim 1, wherein a protrusion is formed on inside wall of the blow-by gas passage in order to separate the oil from the blow-by gas.

14. The device according to claim 13, wherein the protrusion is inclined in the forward direction of the blow-by gas so that contact surface with flow is increased and thus streamlined flow is achieved.

15. An engine comprising a head cover and a device for separating oil, comprising:

a blow-by gas passage provided in the head cover and discharging blow-by gas introduced from the engine therethrough; and a separator disposed in the blow-by gas passage and separating oil from the blow-by gas;

wherein the separator includes:

a pre-separator into which the blow-by gas enters and separates the oil from the blow-by gas, the pre-separator having inlet hole formed upwards and spiral guide vane formed on inside wall of the inlet hole and configured to twist the blow-by gas passing through the spiral guide vane in order to increase a flow rate of the blow-by gas; and a main separator separating the oil from the blow-by gas passing the pre-separator, wherein the blow-by gas passage includes:

an inlet, wherein the blow-by gas introduced to the head cover flows upwards to enter the inlet;

an outlet formed in the head cover to discharge the introduced blow-by gas; and a flow path connecting the inlet to the outlet, wherein the flow path is bent at least once.

16. A passenger vehicle comprising the engine according to claim 15.

* * * * *